US007014074B1

(12) United States Patent
Rinaldi

(10) Patent No.: US 7,014,074 B1
(45) Date of Patent: Mar. 21, 2006

(54) CAPS FOR SELF-DEPLOYING FUNNEL AND POUR SPOUT

(76) Inventor: Mark Rinaldi, 418 Shore Dr. East, Oldsmar, FL (US) 34677

( * ) Notice: Subject to any disclaimer, the term of this patent is extended or adjusted under 35 U.S.C. 154(b) by 0 days.

(21) Appl. No.: 11/213,241

(22) Filed: Aug. 26, 2005

(51) Int. Cl.
*B65D 88/26* (2006.01)

(52) U.S. Cl. ..... 222/461; 222/482; 141/337

(58) Field of Classification Search ..... 222/461, 222/482; 141/337
See application file for complete search history.

(56) References Cited

U.S. PATENT DOCUMENTS 2,138,060 A * 11/1938 Conner ..... 222/540
4,781,314 A * 11/1988 Schoonover et al. ..... 222/465.1
4,811,870 A * 3/1989 Bianco ..... 222/461
6,397,907 B1 * 6/2002 Heintz ..... 141/338
6,935,389 B1 * 8/2005 Rinaldi ..... 141/337

* cited by examiner

*Primary Examiner*—Philippe Derakshani
(74) *Attorney, Agent, or Firm*—Stanley M. Miller

(57) ABSTRACT

A container has a first and a second opening formed in a lid that releasably closes the container. A first base surrounds the first opening and a second base surrounds the second opening. The narrow end of a retractable, self-deploying funnel engages the first opening and the wide end of a retractable, self-deploying pour spout engages the second opening. Both funnel and pour spout are retracted when the first and second caps engage the first and second bases, respectively. The funnel facilitates charging of a liquid into the container and the pour spout facilitates pouring of a liquid from the container. Each cap includes a vent opening formed in a top wall and a nipple formed in depending relation to an interior surface of the top wall. The nipple plugs the narrow end of the pour spout when the pour spout is in its fully retracted configuration.

14 Claims, 2 Drawing Sheets

CAPS FOR SELF-DEPLOYING FUNNEL AND POUR SPOUT

BACKGROUND OF THE INVENTION

1. Field of the Invention

This invention relates, generally, to funnel and pour spout constructions of the type that are connected to a container for liquid fluids. More particularly, it relates to a means for capping a self-deploying funnel or pour spout so that no leakage occurs when the funnel or pour spout is in a fully retracted configuration and the caps are in their respective closed positions.

2. Description of the Prior Art

A self-deploying funnel invented by the present inventor is disclosed in pending U.S. patent application entitled "Self-Deploying Funnel," application Ser. No. 10/974,441, filed Oct. 28, 2004 by the present inventor. That structure includes a cap having utility for engaging a base when a retractable funnel is in its retracted position. The wide end of the funnel is spaced upwardly from the base when the funnel is fully deployed, with the narrow end of the funnel being in fluid communication with an opening formed in a container lid.

An inverted funnel provides a pour spout when its wide end is in fluid communication with an opening formed in a container lid and its narrow end is disposed in vertically spaced relation to said lid. The cap disclosed in said earlier patent application does not prevent leakage if the funnel is in such an inverted, pour spout configuration.

What is needed, then, is a cap that prevents leakage when a retractable funnel construction is in a funnel configuration or in a pour spout configuration.

However, in view of the prior art taken as a whole at the time the present invention was made, it was not obvious to those of ordinary skill how the identified need could be fulfilled.

SUMMARY OF THE INVENTION

The long-standing but heretofore unfulfilled need for a means for a funnel cap construction and a pour spout cap construction that prevents leakage when the funnel or pour spout is in a deployed, operable configuration is now met by a new, useful, and non-obvious invention.

A container includes a rim at its uppermost peripheral edge. A lid for the container includes a rim-engaging means adapted to releasably engage the rim.

A first opening is formed in the lid and a first base is disposed in surrounding relation to the first opening. A first cap is adapted to releasably engage the first base and to thereby close the first opening. A self-deploying funnel has a narrow end mounted about the first opening and a wide end disposed in vertically spaced relation to the first opening when the funnel is deployed into an operative configuration.

A second opening is also formed in the lid and a second base is disposed in surrounding relation to the second opening. A second cap is adapted to releasably engage the second base and to thereby close the second opening. A self-deploying pour spout has a wide end mounted about the second opening and a narrow end disposed in vertically spaced relation to the second opening when the pour spout is deployed into an operative configuration.

A liquid fluid is charged into the container when the first cap is disengaged from the first base and the funnel is deployed with its wide end or mouth disposed above its narrow end.

A liquid fluid is poured from the container when the second cap is disengaged from the second base and the pour spout is deployed with its narrow end disposed above its wide end.

A vent opening is formed in a top wall of the first cap. A vent cap releasably closes the vent opening. The vent cap is preferably but not necessarily attached to the top wall of the first cap by a hinge.

A plug or nipple is formed on an interior surface of the top wall of the first cap in depending relation thereto, centrally thereof.

A vent opening is also formed in a top wall of the second cap and the vent opening of the second cap is releasably closed by a second vent cap that is preferably but not necessarily attached to the top wall of the second cap by a hinge.

A nipple is formed on an interior surface of the top wall of the second cap in depending relation thereto, centrally thereof. The nipple is adapted to plug the narrow end of the pour spout when the pour spout is in a retracted configuration and the second cap is engaged to the second base.

The first and second caps are interchangeable with one another because each has a vent opening, a cap for the vent opening, and a plug or nipple that depends from an interior surface of the top wall of the cap. The nipple is not needed on the first cap and the vent opening is not needed on the second cap but the interchangeability of the caps makes the inventive structure easier for consumers to use.

The lid of the container is recessed with respect to the rim-engaging means formed in the periphery of the lid. The combined height of the first base and the first cap when the first base is engaged by the first cap is equal to the combined height of the second base and the second cap when the second base is engaged by the second cap. Both of said combined heights are equal to or slightly less than the depth of the recess defined by the lid and the rim-engaging means of the lid. This allows vertical stacking of multiple containers having the novel funnel and pour spout built thereinto.

Advantageously, the novel construction provides a container with a self-deploying, retractable funnel and a self-deploying, retractable pour spout. Accordingly, the lid for the container need not be removed when additional liquid is charged into the container or when liquid is being poured therefrom. Moreover, the caps prevent leakage when the funnel and pour spout are retracted or when either or them is retracted.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
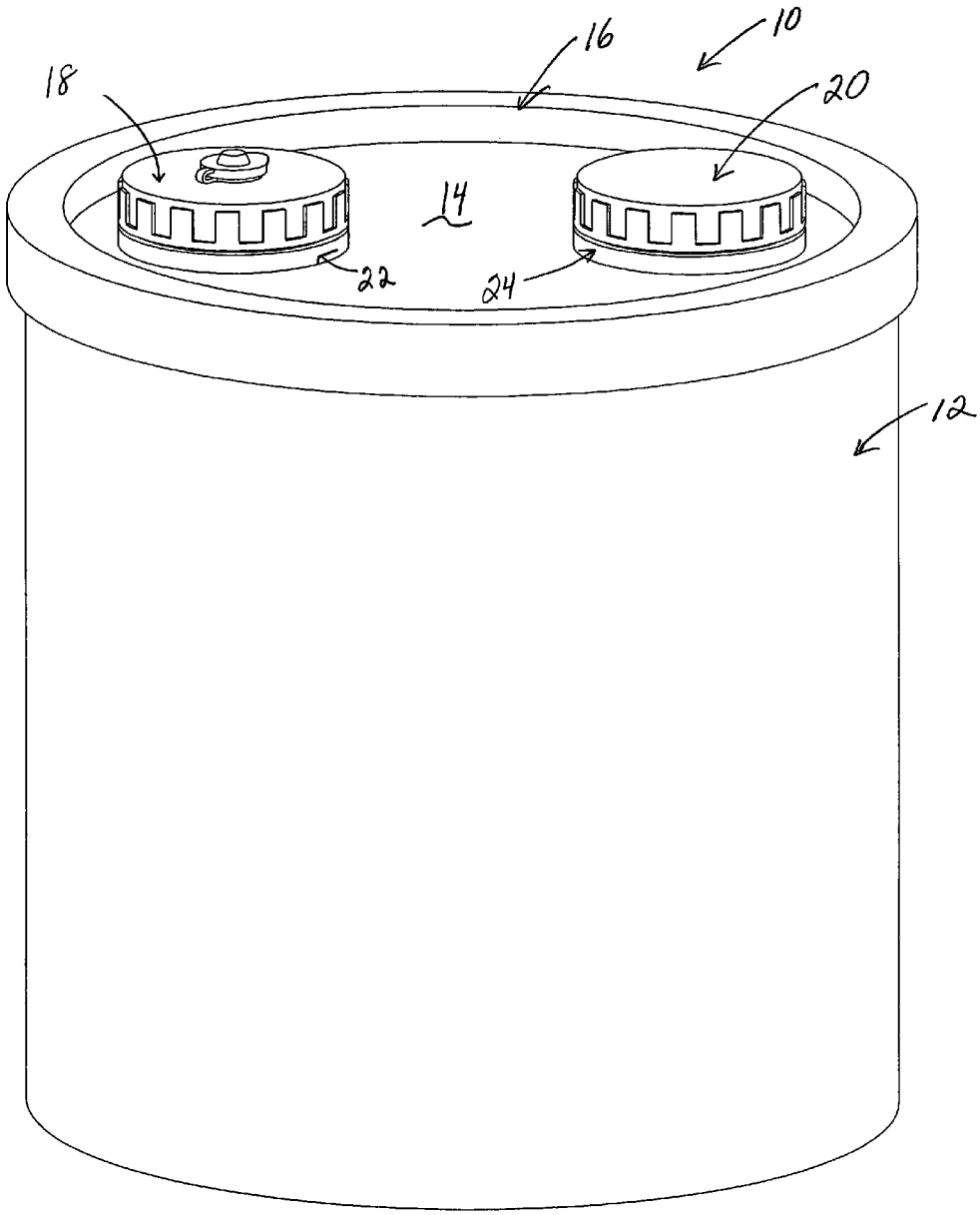
FIG. 1 is a perspective view of a container equipped with the novel caps, depicting said caps in their respective closed configurations.

Referring now to FIG. 1, it will there be seen that an illustrative embodiment of the invention is denoted as a whole by the reference numeral 10. A cylindrical container 12 has a removable lid 14 that includes an annular rim-engaging member 16 that engages the uppermost rim of cylindrical container 12.

A pair of openings is formed in lid 14 and each opening is closed by a cap. In FIG. 1, a first cap is denoted 18 and a second cap is denoted 20. First cap 18 releasably engages base 22 and second cap 20 releasably engages base 24. More particularly, first cap 18 includes top wall 18*a* and annular sidewall 19 that depends from a peripheral edge of top wall 18*a*.

Lid 14 is recessed with respect to rim-engaging member 16. The depth of the recess is substantially equal to or slightly greater than the height of each cap 18, 20 when secured to its base 22, 24, respectively. This allows vertical stacking of containers 12.

Figure 2:
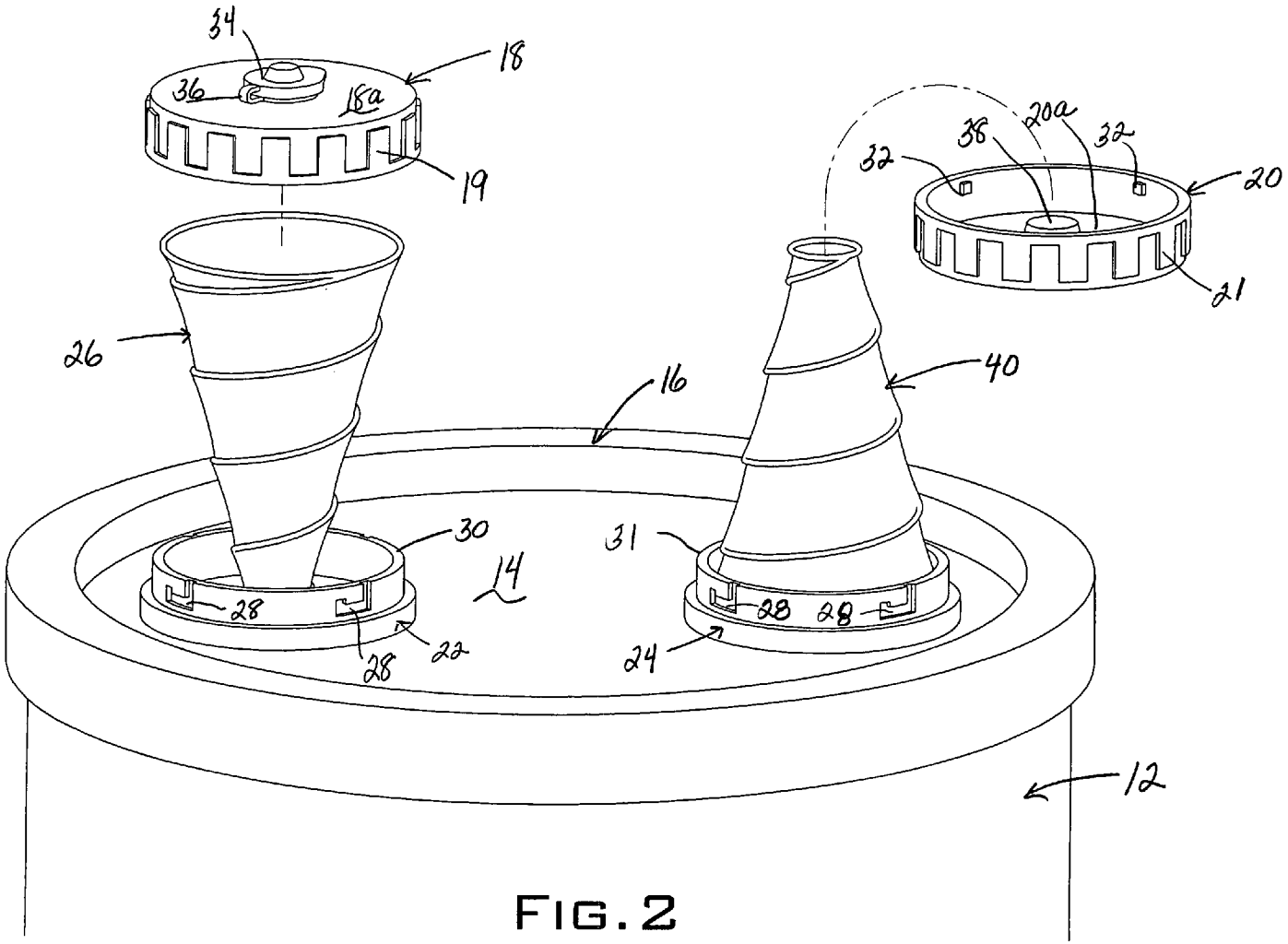
FIG. 2 is an exploded perspective view depicting a deployed funnel and a funnel cap in its upright position and a deployed pour spout and a pour spout cap in an inverted position.

As best understood in connection with FIG. 2, first cap 18, when detached from base 22, allows spring-loaded, retractable funnel 26 to deploy in the manner disclosed in the above-mentioned patent application. The disclosure of that patent application is hereby incorporated by reference into this disclosure.

A plurality of J-shaped catches, collectively denoted 28, are formed in upstanding annular sidewall 30 of base 22. Said catches are engaged by circumferentially spaced apart latches formed integrally with an interior annular surface of said sidewall 19. The circumferentially spaced apart latches cannot be seen due to the orientation of cap 18 in FIG. 2, but they can be seen in second cap 20 in said FIG. 2 due to its inverted configuration. Said circumferentially spaced apart latches are collectively denoted 32 and it should be understood that the unseen latches in first cap 18 are the same as the depicted latches 32 formed in second cap 20. A plurality of J-shaped catches, also collectively denoted 28, are formed in upstanding annular sidewall 31 of base 24 and said catches are engaged by latches 32 formed in depending sidewall 21 of second cap 20.

Vent cap 34 is secured to first cap 18 by a living hinge 36 or other suitable hinge means. Vent cap 34 may be provided with no hinge means. When vent cap is in its closed position as depicted in FIG. 2, it closes a vent or vacuum-breaking opening formed in top wall 18*a* of cap 18.

Second cap 20 includes a frusto-conical nipple 38 that is formed on an interior surface of top wall 20*a* of second cap 20 in depending relation thereto.

A second retractable funnel 40 having a structure like retractable funnel 26 is in an inverted, pour spout configuration in FIG. 2. Its wide end is mounted about the second opening formed in lid 14 and its narrow end is in vertically spaced relation to lid 14.

Nipple 38 slideably engages said narrow end of pour spout 40, plugging it against leakage when second cap 20 is engaged to base 24.

When it is desired to pour liquid from container 12, funnel 26 is placed into its fully retracted configuration as depicted in FIG. 1 and vent cap 34 is opened to break the vacuum within said container. Pour spout 40 is then deployed into its FIG. 2 position and the container is tipped in the well known way to accomplish the desired pouring. Pour spout 40 is then returned to its fully retracted position as depicted in FIG. 1 and second cap 20 is secured to base 24, with nipple 38 plugging the narrow end of said pour spout against leakage.

No nipple 38 is needed in first cap 18. However, to enable caps 18 or 20 to be interchanged with one another, it is preferable to make each of said caps with said nipple. For the same reason, it is desireable to provide a vent cap like vent cap 34 in second cap 20 even though no vent is needed when said second cap is closed and said first cap 18 is open and funnel 26 is extended to allow filling of container 12. In this way, both caps are fully interchangeable with one another.

As in the incorporated disclosure, first and second caps 18, 20 may releasably engage their respective bases by any practical means including mating screwthreads, various types of snap-fit connections, and so on, it being understood that the depicted J-shaped latches and their associated catches are merely one example of the various leak-proof releasable engagement means that may be used advantageously with this invention.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A container having a rim, comprising:

a lid;

said lid including a rim-engaging means adapted to releasably engage said rim;

a first opening formed in said lid;

a first base disposed in surrounding relation to said first opening;

a first cap adapted to releasably engage said first base and to thereby close said first opening;

a self-deploying funnel having a narrow end mounted about said first opening and a wide end disposed in vertically spaced relation to said first opening when said funnel is deployed into an extended, operative configuration;

said self-deploying funnel being in a retracted configuration when said first cap closes said first opening and said self-deploying funnel being in an extended, operative configuration when said first cap is disengaged from said first base;

a second opening formed in said lid;

a second base disposed in surrounding relation to said second opening;

a second cap adapted to releasably engage said second base and to thereby close said second opening;

a self-deploying pour spout having a wide end mounted about said second opening and a narrow end disposed in vertically spaced relation to said second opening when said pour spout is deployed into an operative configuration;

said self-deploying pour spout being in a retracted configuration when said second cap closes said second opening and said self-deploying pour spout being in an extended, operative configuration when said second cap is disengaged from said second base;

whereby a liquid fluid is charged into said container when said first cap is disengaged from said first base and said funnel is deployed into said extended, operative configuration; and whereby a liquid fluid is poured from said container when said second cap is disengaged from said second base and said pour spout is deployed into said extended, operative configuration.

2. The container of claim 1, further comprising:

said first cap including a top wall and an annular sidewall that depends from a periphery of said top wall;

a vent opening formed in said top wall of said first cap.

3. The container of claim 2, further comprising:

a vent cap for releasably closing said vent opening.

4. The container of claim 3, further comprising:

a hinge means for interconnecting said vent cap to said top wall of said first cap.

5. The container of claim 2, further comprising:

a nipple formed on an interior surface of said top wall in depending relation thereto and centrally thereof.

6. The container of claim 2, further comprising:

a plurality of circumferentially spaced apart catches formed on an interior surface of said annular sidewall.

7. The container of claim 6, further comprising:

said first base including an upstanding annular sidewall;

a plurality of circumferentially spaced apart J-shaped latches formed in said upstanding annular sidewall;

each of said J-shaped latches adapted to be engaged by a catch of said plurality of circumferentially spaced apart catches.

8. The container of claim 1, further comprising:

said second cap including a top wall and an annular sidewall that depends from a periphery of said top wall;

a vent opening formed in said top wall of said second cap.

9. The container of claim 8, further comprising:

a vent cap for releasably closing said vent opening formed in said top wall of said second cap.

10. The container of claim 9, further comprising:

a hinge means for interconnecting said vent cap to said top wall of said second cap.

11. The container of claim 8, further comprising:

a nipple formed on an interior surface of said top wall in depending relation thereto and centrally thereof.

12. The container of claim 8, further comprising:

a plurality of circumferentially spaced apart catches formed on an interior surface of said annular sidewall.

13. The container of claim 12, further comprising:

said second base including an upstanding annular sidewall;

a plurality of circumferentially spaced apart J-shaped latches formed in said upstanding annular sidewall of said second base;

each of said J-shaped latches formed in said upstanding annular sidewall of said second base adapted to be engaged by a catch of said plurality of circumferentially spaced apart catches formed on said interior surface of said annular sidewall of said second base.

14. The container of claim 1, further comprising:

said lid being recessed with respect to said rim-engaging means by a predetermined amount;

said first base and said first cap having a first combined height when said funnel is in said retracted configuration and said first cap is disposed in closing relation to said first opening;

said first combined height being equal to or slightly less than said predetermined amount of recess;

said second base and said second cap having a second combined height when said pour spout is in said retracted configuration and said second cap is disposed in closing relation to said second opening;

said second combined height being equal to or slightly less than said predetermined amount of recess;

whereby a plurality of said containers may be vertically stacked in the substantial absence of interference by said first and second caps when said first and second caps are disposed in engaging relation to said first and second bases, respectively.

* * * * *